US007566243B1

(12) United States Patent
Hung

(10) Patent No.: US 7,566,243 B1
(45) Date of Patent: Jul. 28, 2009

(54) CABLE CONNECTOR

(75) Inventor: Tsung-Chin Hung, Chungshan (CN)

(73) Assignee: Sandmartin (Zhong Shan) Electronic Co., Ltd., Chungshan, Kuangtung Province (CN)

( * ) Notice: Subject to any disclaimer, the term of this patent is extended or adjusted under 35 U.S.C. 154(b) by 0 days.

(21) Appl. No.: 11/971,910

(22) Filed: Jan. 10, 2008

(51) Int. Cl.
*H01R 9/05* (2006.01)

(52) U.S. Cl. ..... 439/578; 439/583

(58) Field of Classification Search ..... 439/578, 439/583, 584, 320
See application file for complete search history.

(56) References Cited

U.S. PATENT DOCUMENTS 4,408,822 A * 10/1983 Nikitas ..... 439/583
6,361,348 B1 * 3/2002 Hall et al. ..... 439/352
7,011,547 B1 * 3/2006 Wu ..... 439/584
2004/0077215 A1 * 4/2004 Palinkas et al. ..... 439/578
2006/0134979 A1 * 6/2006 Henningsen ..... 439/583

* cited by examiner

*Primary Examiner*—Hien Vu

(57) ABSTRACT

A cable connector, which includes a hollow body member, a collar fastened to the body member and defining with the body member an accommodation chamber, a sliding member that is axially slidably accommodated in the accommodation chamber and has a tubular core perpendicularly extending from the center of one side of a base thereof and barbed portions formed on the periphery of the free end of the tubular core remote from the base for engagement with an outer cylindrical conducting sheath of a coaxial cable that is inserted into an insertion hole on one end of the collar to stop the outer cylindrical conducting sheath and an outer insulating layer of the coaxial cable against the peripheral edge of the insertion hole of the collar, and a through hole axially extending through the tubular core and the base for receiving an insulating spacer and a central conductor of the coaxial cable, and an elastic member sleeved onto the tubular core of the sliding member and stopped between the base of the sliding member and an inside wall of the collar around the insertion hole of the collar.

9 Claims, 7 Drawing Sheets

CABLE CONNECTOR

BACKGROUND OF THE INVENTION

1. Field of the Invention

The present invention relates to cable connectors and more particularly, to such a cable connector for coaxial cable that enhances its engagement with the connected coaxial cable when the coaxial cable is stretched.

2. Description of the Related Art

A conventional cable connector is known comprising a body member and a collar threaded onto the body member to hold a core tube on the inside. When a cable is inserted through the collar into the core tube inside body member to force a central conductor of the cable into close contact with a matching female metal terminal, the collar is fastened up, thereby locking the cable. However, if the cable is stretched accidentally, the central conductor of the cable may be disconnected from the matching female metal terminal, interrupting signal transmission.

There is known another design of cable connector according to the prior art. This design of cable connector, as shown in FIG. 7, comprises a body member 1, a collar 2 threaded onto one end of the body member 1 and having an insertion hole 21 for the insertion of a coaxial cable 5, and a tubular core 32 that has one end press-fitted into the body member 1 and the other end inserted into the insertion hole 21 of the collar 2. The tubular core 2 has at least one barbed portion 33 for hooking the coaxial cable 5. Because the tubular core 32 is affixed to the body member 1, it is not movable with the coaxial cable 5 when the coaxial cable 5 is stretched accidentally. During installation, a user must fasten the collar 2 tightly to have the barbed portion 33 of the tubular core 32 suspend in the insertion hole 21 so that an outer cylindrical conducting sheath 53 and an outer insulating layer 54 of the coaxial cable 5 can be positively engaged in between the barbed portion 33 of the tubular core 32 and the peripheral edge of the insertion hole 21 of the collar 2. Because the user cannot know whether the barbed portion 33 of the tubular core 32 has reached the place inside the insertion hole 21 during installation, the user must employ much effort to fasten the collar 2 to the body member 1 tightly. Employing an excessively high pressure to the collar 2 against the coaxial cable 5 may cause the outer cylindrical conducting sheath 53 and the outer insulating layer 54 of the coaxial cable 5 to break.

SUMMARY OF THE INVENTION

The present invention has been accomplished under the circumstances in view. It is one object of the present invention to provide a cable connector for fastening to a coaxial cable to keep a central conductor of a coaxial cable in positive contact with a female metal terminal that enhances its engagement with the connected coaxial cable when the coaxial cable is stretched accidentally.

According to one aspect of the present invention, the cable connector comprises a hollow body member, a collar fastened to the body member and having an insertion hole on the center of its one end for the insertion of a coaxial cable and defining with the body member an accommodation chamber, and a sliding member axially slidably accommodated in the accommodation chamber. The sliding member has a tubular core perpendicularly extending from the center of one side of a base thereof and barbered portions formed on the periphery of the free end of the tubular core remote from the base for engagement with an outer cylindrical conducting sheath of a coaxial cable that is inserted into the insertion hole of the collar to stop the outer cylindrical conducting sheath and the outer insulating layer of the coaxial cable against the peripheral edge of the insertion hole of the collar, and a through hole axially extending through said tubular core and the base for receiving an insulating spacer the a central conductor of the coaxial cable.

According to another aspect of the present invention, the cable connector further comprises an elastic member sleeved onto the tubular core of the sliding member and stopped between the base of the sliding member and an inside wall of the collar around the insertion hole of the collar. The elastic member can be, for example, a compression spring. Because the compression spring is sleeved onto the tubular core and stopped between the base of the sliding member and a part inside of the collar, the compression spring prohibits the sliding member from biasing when the connected coaxial cable is stretched to move the sliding member in the accommodation chamber. When the external stretching force disappeared, the compression spring returns the sliding member. When the sliding member is returned to its former position and stopped against the inside wall of the body member, the compression spring holds down the sliding member in place.

DETAILED DESCRIPTION OF THE PREFERRED EMBODIMENT

Figure 1:
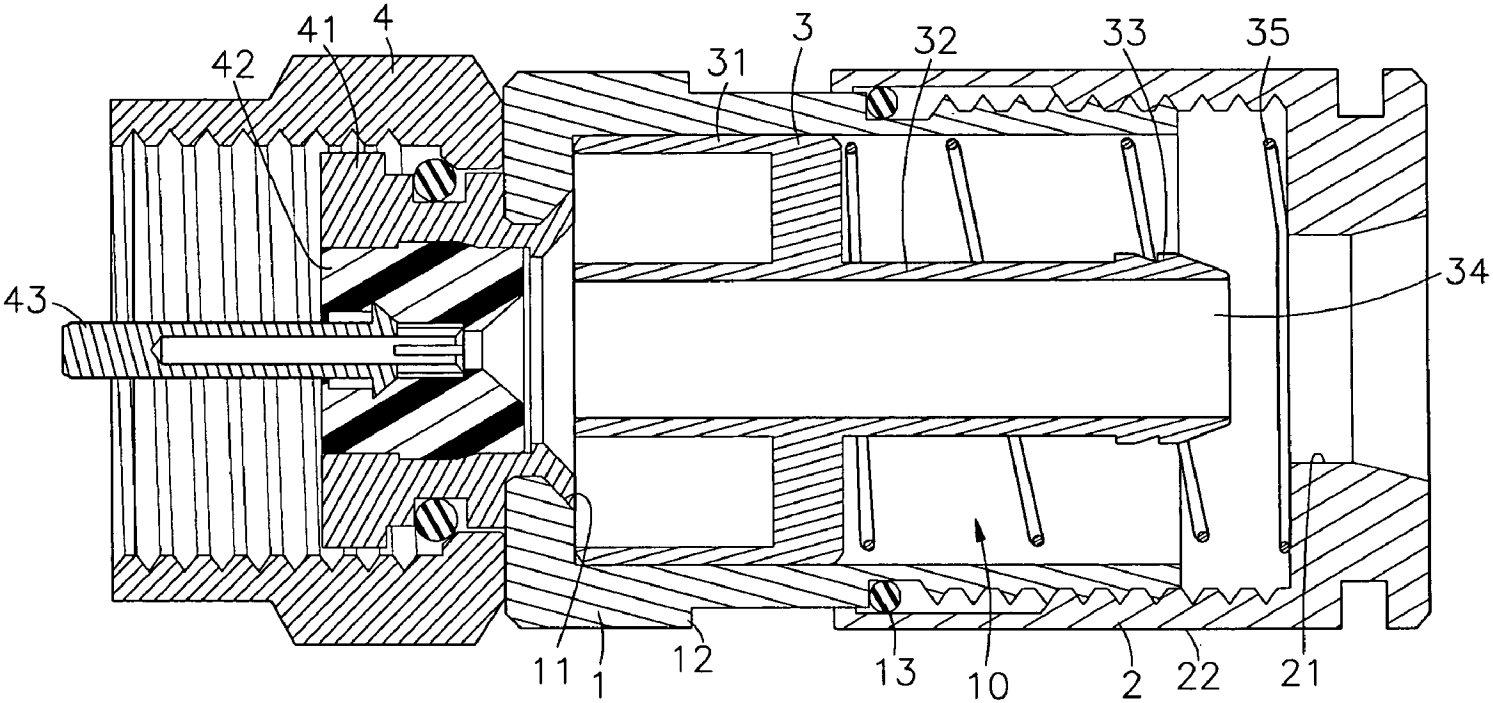
FIG. 1 is a schematic sectional view of a cable connector in accordance with a first embodiment of the present invention.

Referring to FIG. 1, a cable connector in accordance with a first embodiment of the present invention is shown comprised of a body member 1, a collar 2 and a sliding member 3.

The body member 1 is a hollow casing having its first end provided with an axially extending orifice 11 and an embossed portion 12 on the periphery around the orifice 11 and its second end externally threaded.

The collar 2 is internally threaded for threading onto the externally threaded second end of the body member 1, having an embossed portion 22 on the periphery and an insertion hole 21 axially extending on the center its one end. When the collar 2 is threaded onto the externally threaded second end of the body member 1, the body member 1 and the collar 2 define an accommodation chamber 10 for accommodating the sliding member 3.

The sliding member 3 has a base 31 that has a profile substantially equal to but relatively smaller than the inner diameter of the body member 1 such that the base 31 is axially movable in the body member 1, a tubular core 32 perpendicularly extending from the center of one side of the base 31, at least one barbed portion 33 formed on the periphery of the free end of the tubular core 32, and a through hole 34 axially extending through the tubular core 32 and the base 31. According to this embodiment, multiple barbed portions 33 are extending around the periphery of the free end of the tubular core 32 and arranged in parallel. Further, an elastic member, for example, a compression spring 35 is sleeved onto the tubular core 32.

During installation, the sliding member 3 is inserted into the body member 1 and the compression spring 35 is sleeved onto the tubular core 32 of the sliding member 3, and then the collar 2 is threaded onto the externally threaded second end of the body member 1 and stopped at one end of the compression spring 35 to force the base 31 against the inner surface of the peripheral wall of the body member 1 around the orifice 11. When installed, the sliding member 3 can be moved axially in the accommodation chamber 10 defined within the body member 1 and the collar 2.

Figure 2:
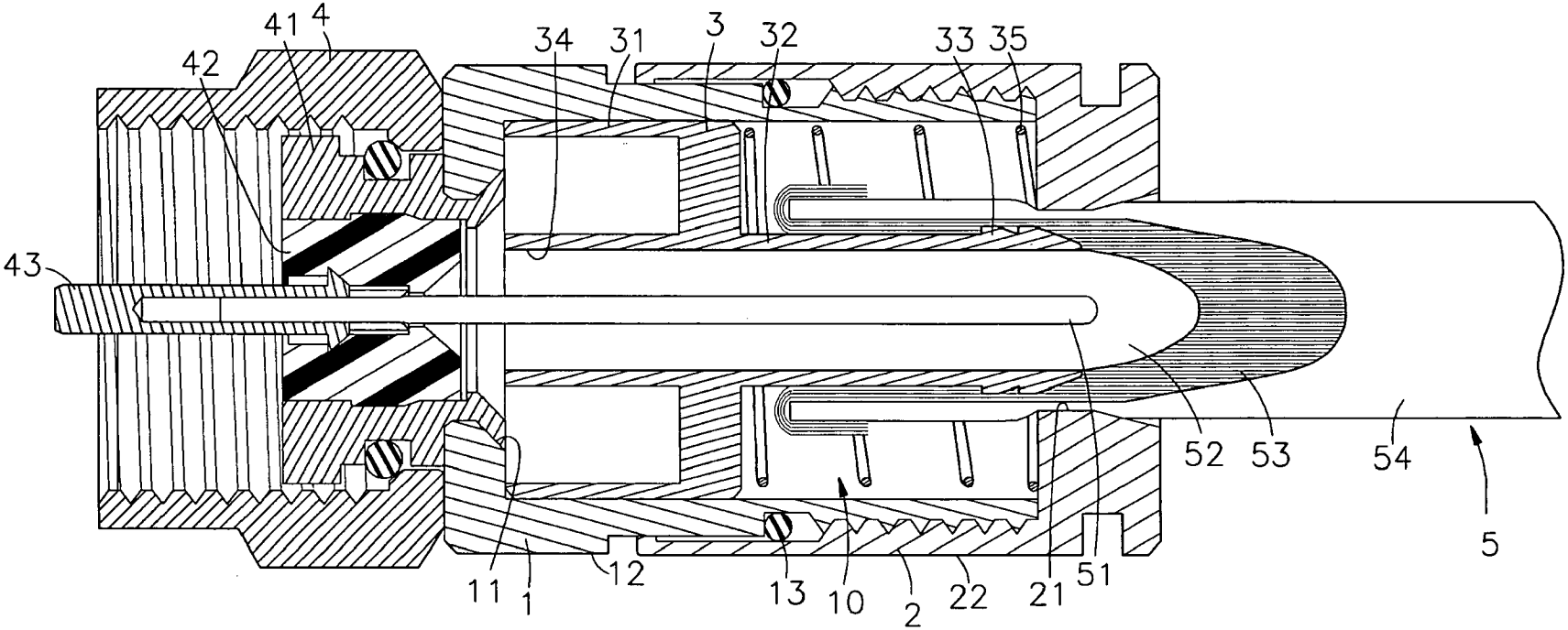
FIG. 2 is a schematic sectional view, showing a coaxial cable installed in the cable connector in accordance with the first embodiment of the present invention.
Figure 3:
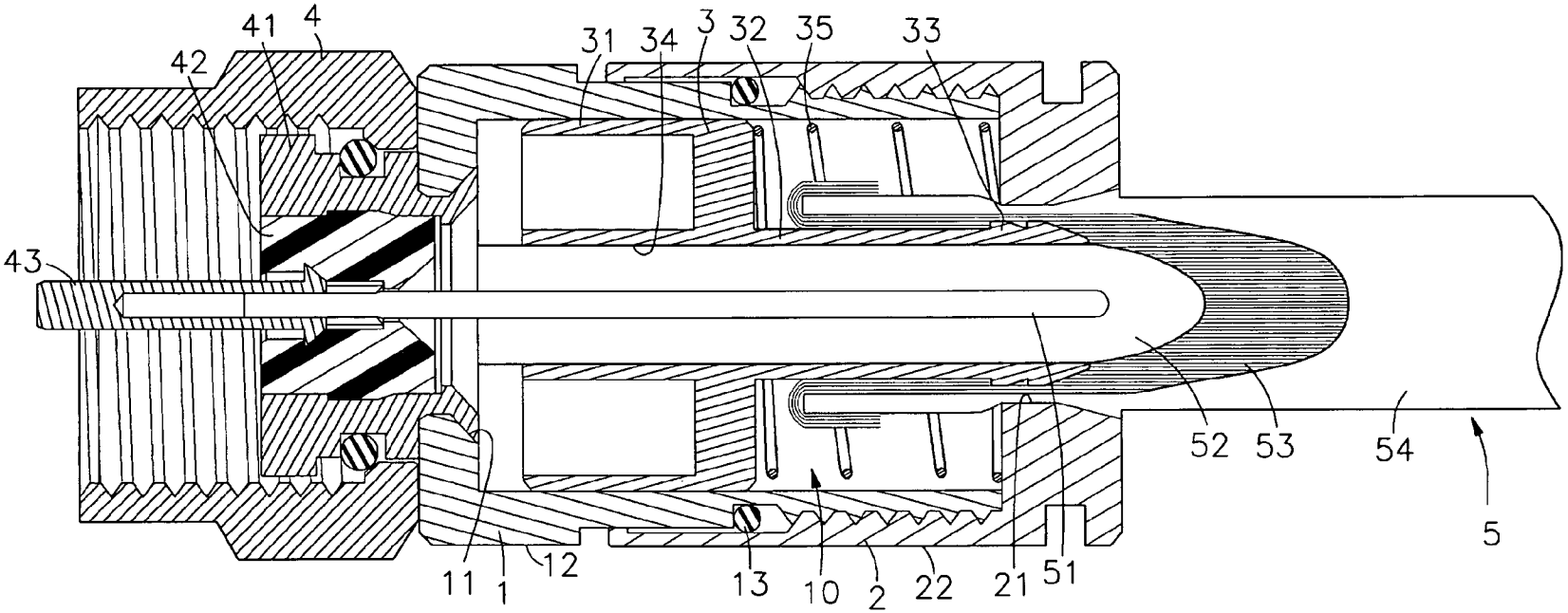
FIG. 3 corresponds to FIG. 2, showing the coaxial cable stretched.

Referring to FIGS. 2 and 3 and FIG. 1 again, the cable connector is adapted for fastening a coaxial cable 5 that comprises a central conductor 51, an insulating spacer 52 surrounding the central conductor 51, an outer cylindrical conducting sheath 53 surrounding the insulating spacer 52, and an outer insulating layer 54 surrounding the outer cylindrical conducting sheath 53. After insertion of the coaxial cable 5 through the insertion hole 21 of the collar 2 into the accommodation chamber 10, the tubular core 32 of the sliding member 3 is inserted in between the insulating spacer 52 and the outer cylindrical conducting sheath 53 of the coaxial cable 5 to have the central conductor 51 and the insulating spacer 52 of the coaxial cable 5 be received in the through hole 34 of the sliding member 3, and the central conductor 51 is inserted through the orifice 11 of the body member 1 to the outside of the cable connector. When fastened up the collar 2 tightly, the barbed portion 33 is forced into positive engagement with the outer cylindrical conducting sheath 53 of the coaxial cable 5.

As stated above, after insertion of the coaxial cable 5 into the insertion hole 21 of the collar 2, a user simply needs to rotate the collar 2 forwards toward the body member 1. At this time, the compression spring 35 will be forced to impart an axial pressure to the sliding member 3 in direction toward the collar 2 toward the body member 1, thereby forcing the barbed portion 33 into positive engagement with the outer cylindrical conducting sheath 53 of the coaxial cable 5. Therefore, the installation of the present invention is quick simple without much effort or the use of any tools.

When the coaxial cable 5 is stretched outwards accidentally, the sliding member 3 will be moved with the coaxial cable 5 to compress the compression spring 35, and at the same time the barbed portion 33 will force the outer cylindrical conducting sheath 53 and the outer insulating layer 54 of the coaxial cable 5 against the periphery of the insertion hole 21 of the collar 2, securing the coaxial cable 5 tightly to the collar 2. Therefore, increasing the outward stretching force will enhance the engagement between the coaxial cable 5 and the cable connector.

Further, because the distance between the insertion hole 21 and the barbed portion 33 is shorter than the combined thickness of the outer cylindrical conducting sheath 53 and the outer insulating layer 54 of the coaxial cable 5, the outer cylindrical conducting sheath 53 and the outer insulating layer 54 of the coaxial cable 5 will be forced to deform a certain length of time after having been squeezed between the barbed portion 33 of the sliding member 3 and the periphery of the insertion hole 21 of the collar 2 if the sliding member 3 is not returned to its former position. This problem is prevented because the spring force of the compression spring 35 automatically returns the sliding member 3 to its former position immediately after disappearance of the external stretching force. Therefore, the invention greatly prolongs the service life of the cable connector and the cable.

Further, because the compression spring 35 is sleeved onto the tubular core 32 and stopped between the base 31 of the sliding member 3 and a part inside of the collar 2, the compression spring 35 prohibits the sliding member 3 from biasing during sliding movement of the sliding member 3 in the accommodation chamber 10. When the sliding member 3 is returned to its former position and stopped against the peripheral wall of the body member 1 around the orifice 11, the compression spring 35 holds down the sliding member 3 in place.

The cable connector further comprises a terminal holder unit 4 fastened to the orifice 11 of the body member 1. The terminal holder unit 4 comprises a locating member 41 that has one end hooked in the orifice 11 of the body member 1, a terminal bearing member 42 fastened to the inside of the locating member 41, and a female metal terminal 43 axially mounted in the terminal bearing member 42. When the coaxial cable 5 is inserted into the body member 1 and the collar 2, the central conductor 51 of the coaxial cable 5 is inserted through the orifice 11 of the body member 1 into the inside of the female metal terminal 43 and kept in close contact with the inside wall of the female metal terminal 43, and therefore the coaxial cable 5 is electrically connected to the electric socket (not shown) to which the terminal holder unit 4 is fastened.

Further, a gasket ring 13 is mounted in between the body member 1 and the collar 2 to seal a gap between the body member 1 and the collar 2. After insertion of the coaxial cable 5 into the body member 1 and the collar 2, the coaxial cable 5 blocks the insertion hole 21 of the collar 2, and therefore the gasket ring 13 and the terminal bearing member 42 keep the accommodation chamber 10 in a watertight status.

Figure 4:
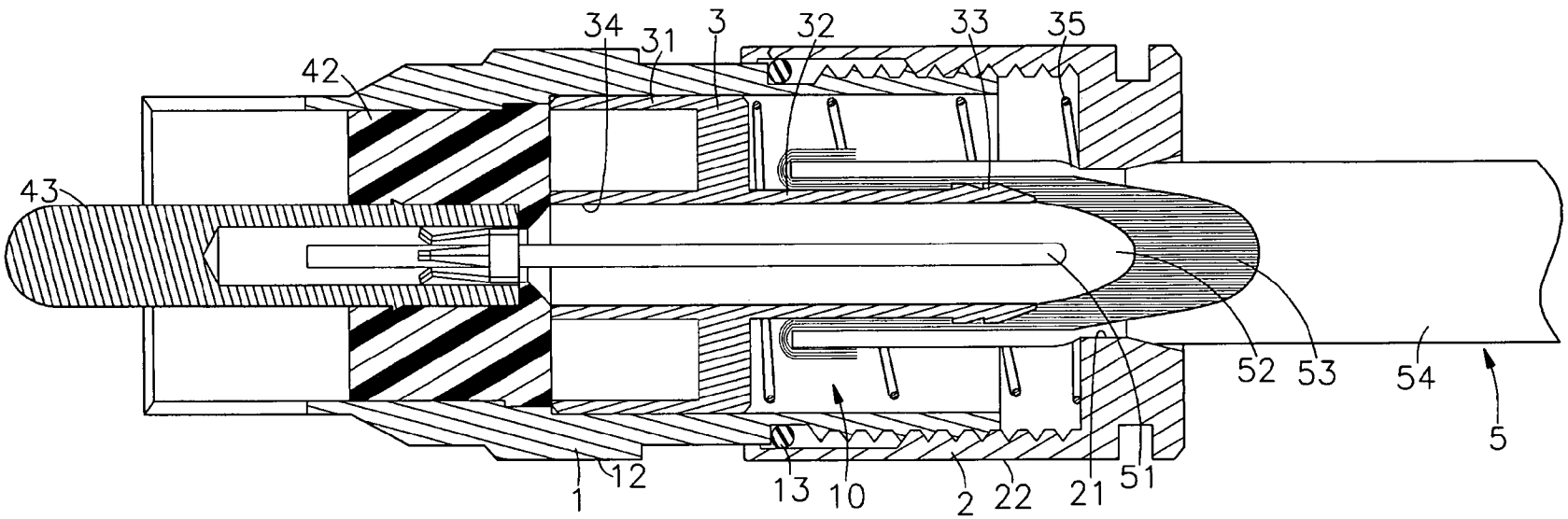
FIG. 4 is a schematic sectional view of a cable connector in accordance with a second embodiment of the present invention.

FIG. 4 is a schematic sectional view of a cable connector in accordance with a second embodiment of the present invention. This second embodiment is substantially similar to the aforesaid first embodiment with the exception that the body member 1 of this second embodiment is relatively longer than the aforesaid first embodiment so that the terminal bearing member 42 and the female metal terminal 43 are directly mounted inside the body member 1 for the connection of the central conductor 51 of the coaxial cable 5.

Figure 5:
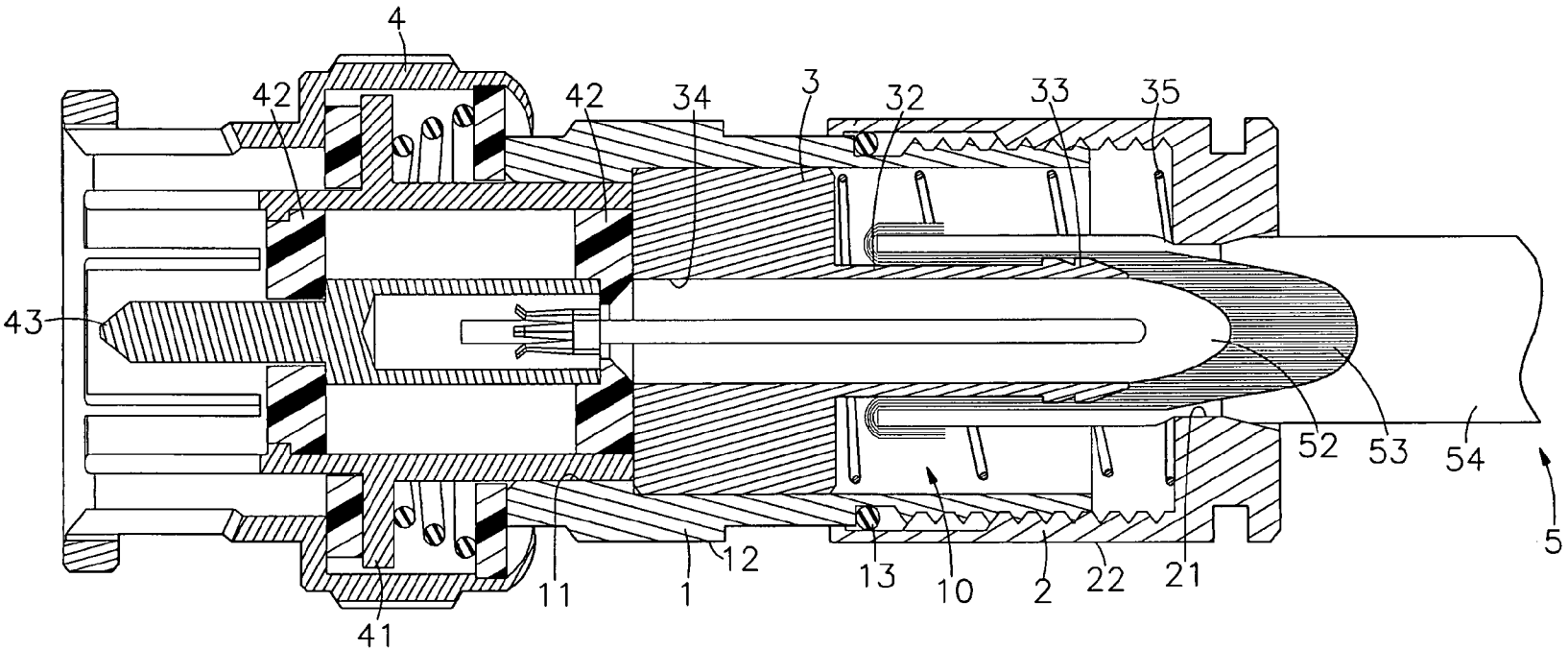
FIG. 5 is a schematic sectional view of a cable connector in accordance with a third embodiment of the present invention.

FIG. 5 is a schematic sectional view of a cable connector in accordance with a third embodiment of the present invention. This third embodiment is substantially similar to the aforesaid first embodiment with the exception that the terminal holder unit 4 of this third embodiment is directly fastened to the outside wall of the body member 1 to hold the locating member 41 in the body member 1, and two terminal bearing members 42 are fastened to the front and rear sides inside to hold the female metal terminal 43 for the connection of the central conductor 51 of the coaxial cable 5.

Figure 6:
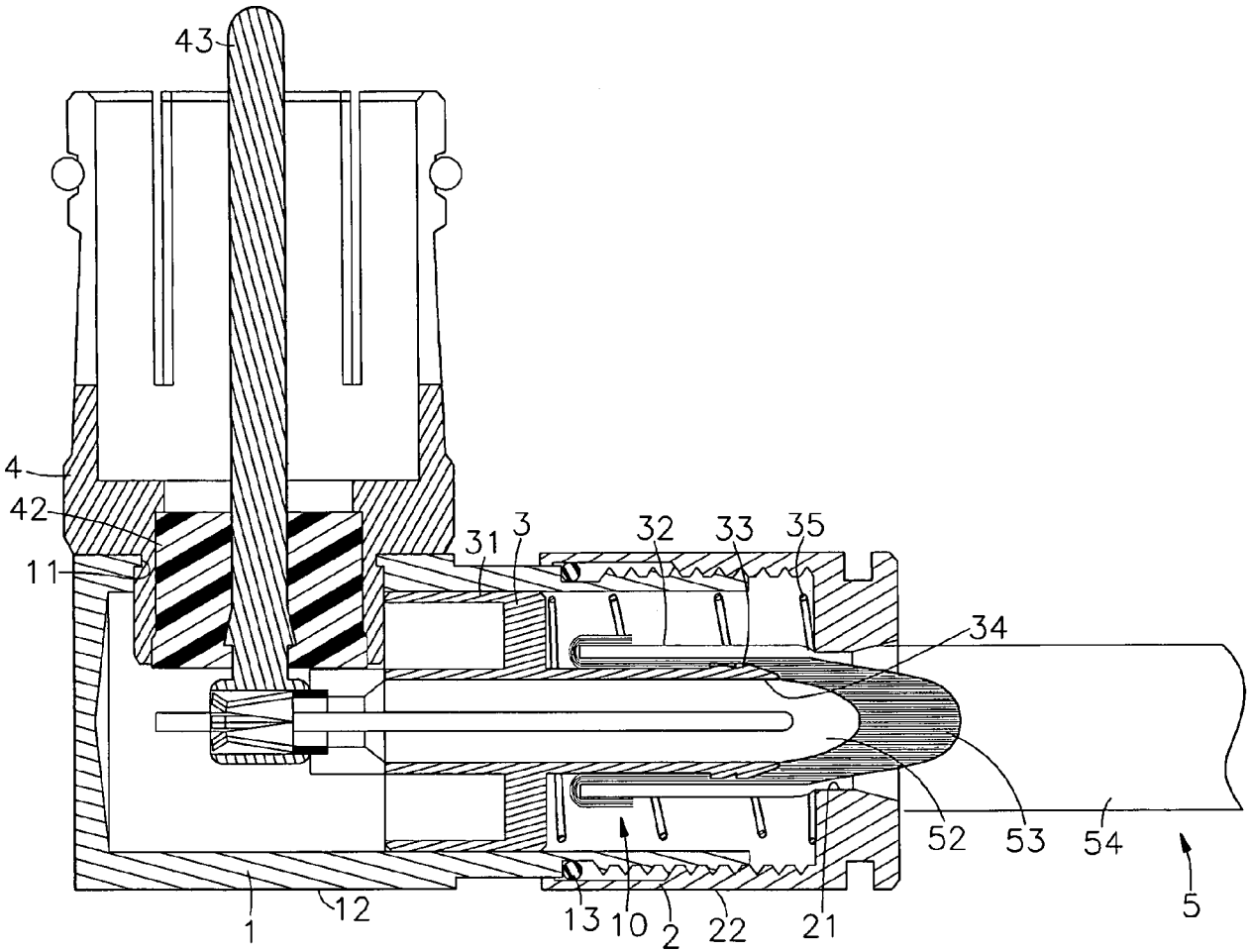
FIG. 6 is a schematic sectional view of a cable connector in accordance with a fourth embodiment of the present invention.
Figure 7:
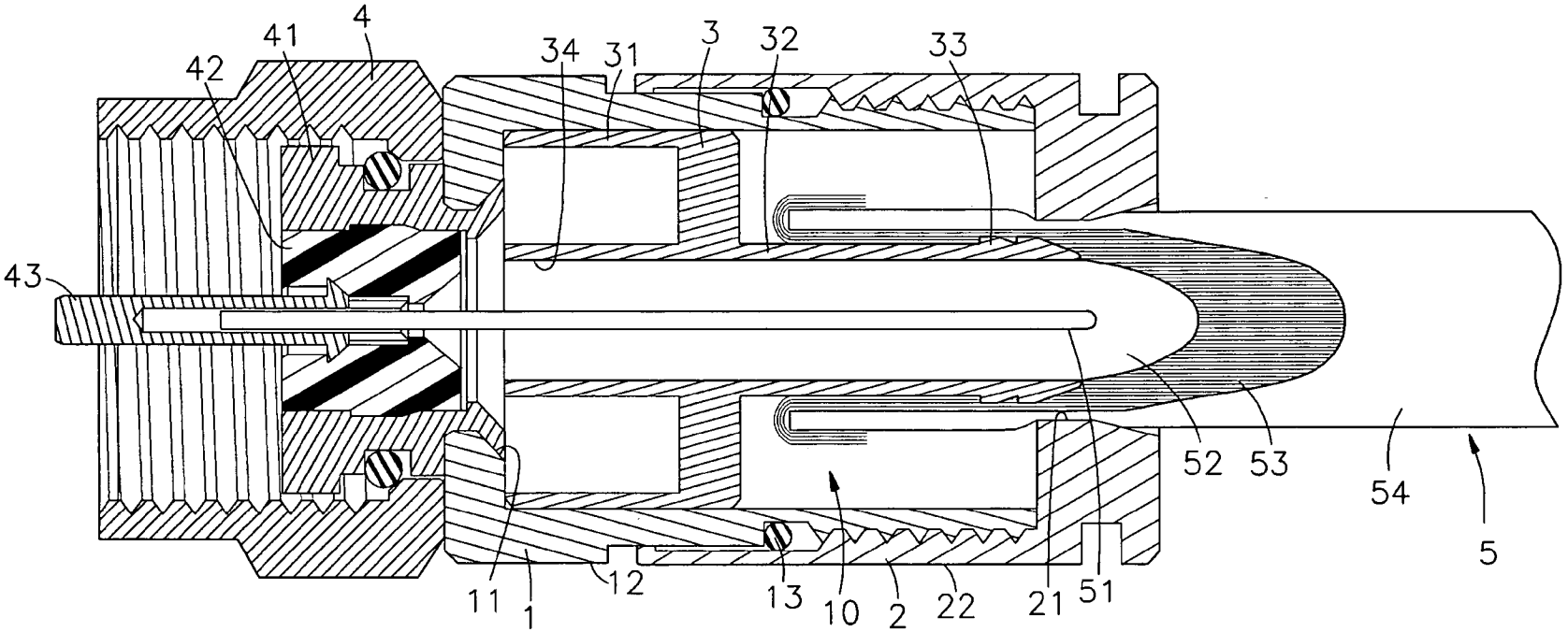
FIG. 7 is a schematic sectional view of a cable connector according to the prior art.

FIG. 6 is a schematic sectional view of a cable connector in accordance with a fourth embodiment of the present invention. This fourth embodiment is substantially similar to the aforesaid first embodiment with the exception that the body member 1 is an angled casing with its orifice 11 extending vertically upwards for the mounting of the terminal holder unit 4 so that the female metal terminal 43 and the central conductor 51 of the coaxial cable 5 are connected at right angles.

In conclusion, the invention provides a cable connector that comprises a body member 1 that is a hollow casing having an orifice 11 at one end, a collar 2 fastened to the body member 1 and having an insertion hole 21 in axial alignment with the orifice 11 of the body member 1 and defining with the body member 1 an accommodation chamber 10 in communication between the insertion hole 21 of the collar 2 and the orifice 11 of the body member 1, a sliding member 3 that is accommodated in the accommodation chamber 10 and having a tubular core 32 extending from the center of one side of a base 31 thereof and terminating in a barbed portion 33, and an elastic member, for example, compression spring 35 sleeved onto the tubular core 32 and stopped between the base 31 of the sliding member 3 and an inside wall of the collar 2 around the insertion hole 21. When a coaxial cable 5 is inserted into the insertion hole 21 of the collar 2, the tubular core 32 of the sliding member 3 is inserted in between an insulating spacer 52 and an outer cylindrical conducting sheath 53 of the coaxial cable 5, a central conductor 51 and the insulating spacer 52 of the coaxial cable 5 are received in the tubular core 32 of the sliding member 3, and the central conductor 51 of the coaxial cable inserted through the orifice 11 to the outside of the body member 1 for connection to a female metal terminal 43. When fastened up the collar 2, the collar 2 imparts a pressure to the outer insulating layer 54 and the outer cylindrical conducting sheath 53 of the coaxial cable 5 in positive engagement with the barbed portions 33 of the sliding member 3. In case the coaxial cable 5 is stretched accidentally, the barbed portions 33 of the sliding member 3 will be pulled toward the insertion hole 21 of the collar 2, thereby giving a pressure to the outer cylindrical conducting sheath 53 and the outer insulating layer 54 of the coaxial cable 5 against the peripheral edge of the insertion hole 21 of the collar 2, enhancing the engagement between the coaxial cable 5 and the cable connector.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cable connector comprising:

a body member formed of a hollow casing;

a collar fastened to one end of said body member, said collar defining with said body member an accommodation chamber, said collar having an insertion hole axially extending on the center of one end thereof for the insertion of a coaxial cable that comprises a central conductor, an insulating spacer surrounding said central conductor, an outer cylindrical conducting sheath surrounding said insulating spacer, and an outer insulating layer surrounding said outer cylindrical conducting sheath;

a sliding member axially slidably accommodated in said accommodation chamber inside said body member and said collar, said sliding member comprising a base that has a profile fitting the shape of the inner diameter of the hollow casing of said body member, a tubular core perpendicularly extending from the center of one side of said base for receiving said insulating spacer and said central conductor of said coaxial cable that is inserted into the insertion hole of said collar, at least one barbered portion formed on the periphery of a distal end of said tubular core remote from said base for engagement with said outer cylindrical conducting sheath of said coaxial cable that is inserted into said insertion hole of said collar to stop said outer cylindrical conducting sheath and said outer insulating layer of said coaxial cable against the peripheral edge of said insertion hole of said collar; and an elastic member sleeved onto said tubular core of said sliding member and stopped between said base of said sliding member and an inside wall of said collar around said insertion hole of said collar.

2. The cable connector as claimed in claim 1, wherein said body member has one end externally threaded, and said collar is internally threaded for threading onto said externally threaded end of said body member.

3. The cable connector as claimed in claim 2, wherein said body member has an embossed portion on the periphery thereof remote from said externally threaded end.

4. The cable connector as claimed in claim 2, wherein said collar has an embossed portion on the periphery thereof.

5. The cable connector as claimed in claim 1, further comprising a get ring mounted in between said body member and said collar.

6. The cable connector as claimed in claim 1, wherein said base has a through hole cut through said base in axial alignment between the inside space of said tubular core for receiving said insulating spacer and said central conductor of said coaxial cable that is inserted into said insertion hole of said collar.

7. The cable connector as claimed in claim 1, wherein said sliding member comprises multiple barbered portions extending around the periphery of a distal end of said tubular core remote from said base and arranged in parallel.

8. The cable connector as claimed in claim 1, wherein said body member has an orifice on the center of one end thereof remote from said collar for the passing of said central conductor of said coaxial cable that is inserted into said insertion hole of said collar.

9. The cable connector as claimed in claim 8, further comprising a terminal holder unit fastened to said orifice of said body member, said terminal holder unit comprising a locating member with one end thereof hooked in said orifice of said body member, a terminal bearing member fastened to inside said locating member, and a female metal terminal axially mounted in said terminal bearing member for the connection of said central conductor of said coaxial cable that is inserted into said insertion hole of said collar.

* * * * *